US007921827B2

(12) United States Patent
Kobayashi et al.

(10) Patent No.: US 7,921,827 B2
(45) Date of Patent: Apr. 12, 2011

(54) ACCUMULATOR FUEL INJECTION DEVICE

(75) Inventors: Nobu Kobayashi, Osaka (JP); Hajimu Imanaka, Osaka (JP); Mitsuyoshi Kawarabayashi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 161 days.

(21) Appl. No.: 12/377,477

(22) PCT Filed: Jul. 23, 2007

(86) PCT No.: PCT/JP2007/064453
§ 371 (c)(1),
(2), (4) Date: Apr. 3, 2009

(87) PCT Pub. No.: WO2008/020530
PCT Pub. Date: Feb. 21, 2008

(65) Prior Publication Data

US 2010/0275881 A1 Nov. 4, 2010

(30) Foreign Application Priority Data

Aug. 16, 2006 (JP) ..... 2006-222084

(51) Int. Cl.
*F02M 59/36* (2006.01)

(52) U.S. Cl. ..... 123/458; 251/48

(58) Field of Classification Search ..... 123/457, 123/458, 459, 460, 462; 251/48, 50, 53, 251/54; 137/514, 514.3
See application file for complete search history.

(56) References Cited

U.S. PATENT DOCUMENTS 5,174,334 A * 12/1992 Nogle ..... 137/596.17
5,239,968 A * 8/1993 Rodriguez-Amaya et al. ..... 123/506
5,423,602 A * 6/1995 Takahashi ..... 303/119.2
5,601,275 A * 2/1997 Hironaka ..... 251/129.15
5,651,501 A * 7/1997 Maley et al. ..... 239/88
5,984,259 A * 11/1999 Najmolhoda et al. ..... 251/50
6,161,813 A * 12/2000 Baumgartner et al. ..... 251/50
6,209,970 B1 * 4/2001 Kamiya et al. ..... 303/119.2

(Continued)

FOREIGN PATENT DOCUMENTS

JP 03-102668 10/1991

(Continued)

OTHER PUBLICATIONS

International Search Report for International Application No. PCT/JP2007/064453, Japanese Patent Office, mailed Oct. 23, 2007, 2 pgs.

*Primary Examiner* — Thomas N Moulis
(74) *Attorney, Agent, or Firm* — Sterne, Kessler, Goldstein & Fox, P.L.L.C.

(57) ABSTRACT

To provide an accumulator fuel injection device, so as to stabilize the operation of a pressure control valve for controlling a fuel pressure in an accumulator. The accumulator fuel injection device includes a pressure control valve 6 for controlling the fuel pressure in the accumulator by moving an armature 13 in an armature chamber 22 and by adjusting escaped volumes of the fuels from the accumulator 2 due to a valving element 11 formed integral with the armature 13 in a control chamber 21 introducing the fuels in the accumulator 2. A means for attenuating the pressure transmitted from the accumulator 2 to the valve seat 10 is provided in the valve seat 10 disposed between the control chamber 21 and the accumulator 2 of the pressure control valve 6.

2 Claims, 3 Drawing Sheets

U.S. PATENT DOCUMENTS

| | | | | |
|---|---|---|---|---|
| 6,223,761 | B1 * | 5/2001 | Najmolhoda et al. | 137/14 |
| 6,305,355 | B1 * | 10/2001 | Hoffmann et al. | 123/467 |
| 6,435,472 | B1 * | 8/2002 | Najmolhoda et al. | 251/50 |
| 6,810,909 | B2 * | 11/2004 | Herbert et al. | 137/596.17 |
| 7,334,770 | B2 * | 2/2008 | Wang et al. | 251/30.01 |
| 7,350,539 | B2 * | 4/2008 | Kaneko | 137/514 |
| 7,766,040 | B2 * | 8/2010 | Bamber | 137/625.26 |
| 2002/0000219 | A1 * | 1/2002 | Augustin et al. | 123/502 |
| 2002/0117216 | A1 * | 8/2002 | Ambrose et al. | 137/596.17 |

FOREIGN PATENT DOCUMENTS

| | | |
|---|---|---|
| JP | 08-072687 | 3/1996 |
| JP | 08-261102 | 10/1996 |
| JP | 2000-291474 | 10/2000 |
| JP | 2004-515727 | 5/2004 |
| JP | 2006-083821 | 3/2006 |

* cited by examiner

ACCUMULATOR FUEL INJECTION DEVICE

BACKGROUND OF THE INVENTION

1. Field of the Invention

The present invention relates to an accumulator fuel injection device provided with a pressure control valve controlling a fuel pressure in the accumulator by moving an armature in an armature chamber and by adjusting escaped volumes of the fuel from the accumulator using a valving element formed integrally with the armature in a control chamber introducing the fuel in the accumulator.

2. Related Art

Conventionally, there are well-known accumulator fuel injection devices of an engine, comprising a supply pump, an accumulator storing highly-pressurized fuels pumped from the supply pump and an injector injecting the fuels supplied from the accumulator (for example, see JP2006-83821). These accumulator fuel injection devices were provided in the accumulator thereof with pressure sensors so as to detect the fuel pressures in the accumulator and solenoid valves so as to escape the fuels from the accumulator.

The solenoid valves are constructed so that they can reduce the fuel pressures in the accumulator by moving the armature in an armature chamber and by adjusting escaped volumes of the fuels from the accumulator using a valving element formed integrally with an armature in a control chamber introducing the fuels in the accumulator. The switching of the solenoid valves are controlled based on detected values of the fuel pressures by the pressure sensors, thereby keeping the fuel pressures in the accumulator to the given pressures.

However, in the conventional accumulator fuel injection devices, when the pressures in the accumulator are largely varied, they are approximately directly transmitted from the accumulator to the pressure control valves, thereby largely varying pressures of valve seats of the pressure control valves. The pressures of the control chamber and the armature chamber are not equalized in the pressure control valve, so that sometimes the valving element was not accurately controlled using the armature. Accordingly, operation of the pressure control valve was unstable.

SUMMARY OF THE INVENTION

A pressure regulation valve for an accumulator fuel injection device of the present invention is a pressure regulation valve for controlling a fuel pressure of an accumulator in the accumulator fuel injection device, comprising integrally of an armature chamber, an armature moving in the armature chamber, a control chamber introducing the fuels in the accumulator, a valving element and a valve seat having a passage between the accumulator and the control chamber, wherein it adjusts escaped volumes of the fuels from the accumulator to the control chamber, by moving the valving element with the movement of the armature so as to open and close the passage in the valve seat, and in the pressure regulation valve having these structures, a pressure attenuating means for attenuating the pressure transmitted from the accumulator via the passage to the valve seat is provided in the valve seat.

In the pressure regulation valve, the passage in the valve seat is provided with an attenuating chamber and the attenuating chamber is provided on each of the side of the accumulator and the side of the control chamber with apertures, wherein the pressure attenuating means is comprised of the attenuating chamber and both apertures.

A pressure regulation valve for controlling a fuel pressure of an accumulator in an accumulator fuel injection device, comprising integrally of an armature chamber, an armature moving in the armature chamber, a control chamber introducing the fuels in the accumulator, a valving element and a shaft moving integral with the armature so as to move the valving element, wherein it adjusts escaped volumes of the fuels from the accumulator to the control chamber, by moving the valving element with the movement of the armature and the shaft so as to open and close the passage between the accumulator and the control chamber, and a pressure equalizing means for equalizing the pressures of the control chamber and the armature chamber is provided in the pressure regulation valve having these structures.

In the pressure regulation valve, the shaft is provided with a first continuous hole communicating with the control chamber, and the armature is provided with a second continuous hole communicating with the first continuous hole and the armature chamber, wherein the pressure equalizing means is comprised of the first continuous hole and the second continuous hole and the second continuous hole has a continuous hole consisting of a chase on the outer peripheral portion of the armature and a cylindrical member that incorporates the armature with no space.

The pressure regulation valve for an accumulator fuel injection device of the present invention can control so that the pressure fluctuation in the accumulator is not directly transmitted to the valve seat of the pressure control valve by the pressure attenuating means, thereby minimizing the pressure fluctuation of the valve seat so as to stabilize the operation of the pressure control valve.

The pressure attenuating means is provided on the passage of the valve seat thereof with an attenuating chamber, and it is provided on each of the side of the accumulator and the side of the control chamber in the attenuating chamber with apertures, comprising of the attenuating chamber and both apertures, so that the pressure attenuating means can be constructed using a simple structure so as to restrain the production cost.

The pressure regulation valve for an accumulator fuel injection device of the present invention is provided with the pressure equalizing means, so that the pressures exerting on each of the side end portion of the control chamber acting on the valving element of the armature and the side end portion of the armature chamber can be balanced out, thereby accurately controlling the valving element by the armature so as to stabilize the operation of the pressure control valve.

The pressure equalizing means is comprised of the first continuous hole provided with the shaft and the second continuous hole provided with the armature, so that the pressure equalizing means can be constructed using a simple structure so as to restrain the production cost.

DETAILED DESCRIPTION OF THE INVENTION

Figure 1:
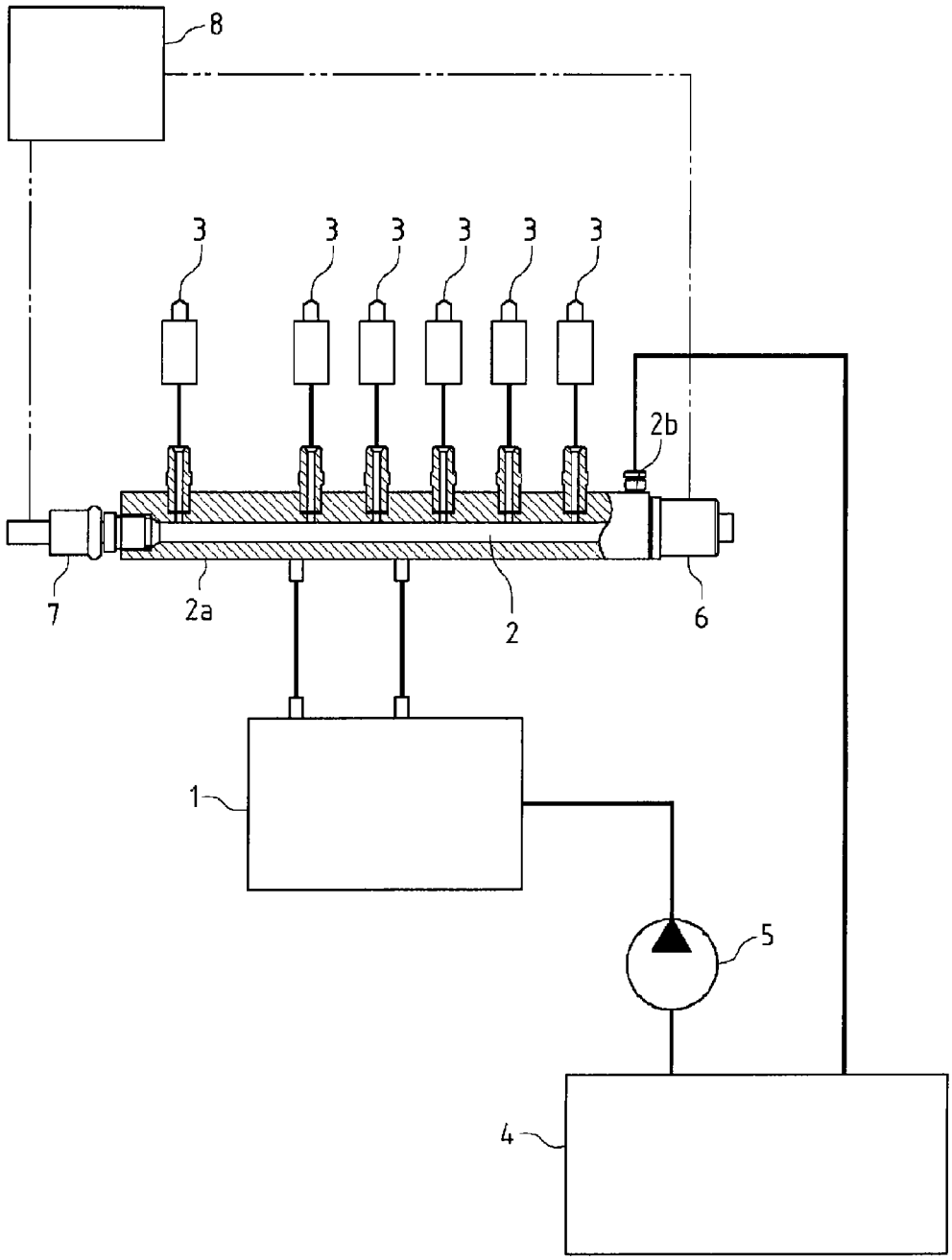
FIG. 1 is a diagram of an entire construction of an accumulator fuel injection device according to an embodiment of the present invention.

As shown in FIG. 1, an accumulator fuel injection device of an engine comprises a supply pump 1, an accumulator 2, and plurality of injectors 3,3 or the like. The accumulator fuel injection device pressurizes the fuel inhaled from a fuel tank 4 via a feed pump 5 by the supply pump 1 so as to pump it into the accumulator 2, and stores the highly-pressured fuels in the accumulator 2 so as to inject the fuels supplied from the accumulator 2 by the respective injectors 3 into a combustion chamber.

The accumulator 2 includes a pressure control valve 6 controlling the fuel pressure in the accumulator 2, a switching of which results in escaping the fuels from the accumulator 2 to the fuel tank 4 so as to lower the fuel pressure in the accumulator 2. The accumulator 2 also includes a pressure sensor 7 for detecting the fuel pressure in the accumulator 2, which is connected to a controller 8 with the pressure control valve 6. The controller 8 controls the switching of the pressure control valve 6 based on the detected value of the fuel pressure by the pressure sensor 7 and adjusts the escaped volumes of the fuels so as to keep the fuel pressure in the accumulator 2 to the given pressure.

Figure 2:
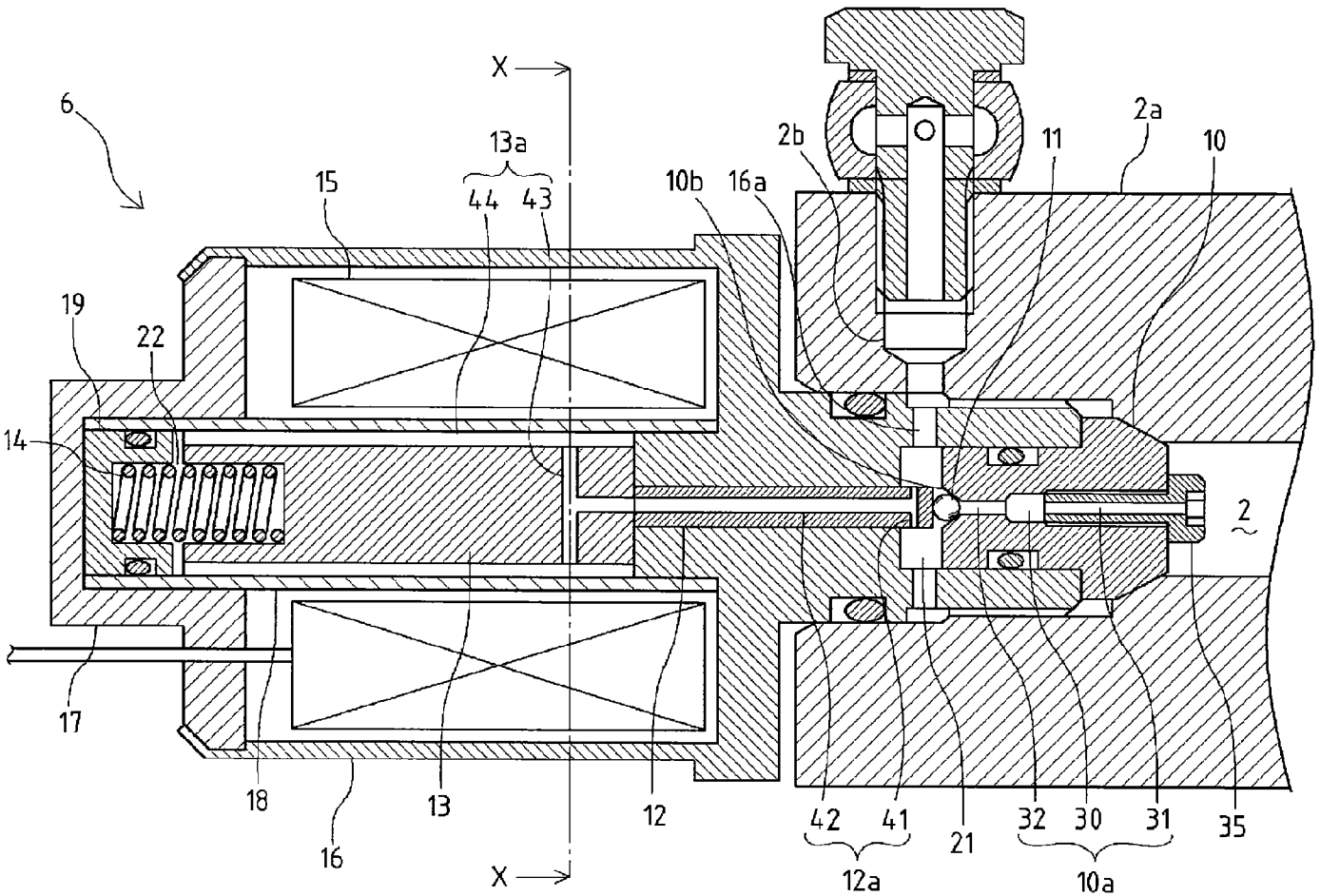
FIG. 2 is a cross-sectional view of a pressure control valve.

As shown in FIG. 2, the pressure control valve 6 is comprised of a solenoid valve and includes a valve seat 10 having a fuel passage 10*a* leading to the accumulator 2, a ball-like valving element 11 so as to close the fuel passage 10*a* of the valve seat 10, an armature 13 which can press the valving element 11 via a shaft 12, a spring 14 which biases in the direction where the armature 13 presses the valving element 11 on the valve seat 10 and a solenoid 15 which biases the armature 13 in the same direction as the biasing one of the spring 14 or the like, all of which are constructed as a valve holding member 16.

In the pressure control valve 6, a part of the valve holding member 16 is inserted and fixed into one end of an accumulator body 2*a*, and the valve seat 10 is fitted onto the inner portion of the accumulator 2 of the valve holding member 16. The control chamber 21 is formed between the valve seat 10 and the valve holding member 16. The control chamber 21 is communicated with the accumulator 2 via the fuel passage 10*a* formed in the valve seat 10 and is connected to a fuel escaping passage 2*b* of the accumulator 2 via a fuel passage 16*a* formed in the valve holding member 16. The control chamber 21 is provided with the valving element 11, which can be pressed and attached to a sheet surface 10*b* so as to close the fuel passage 10*a* of the valve seat 10.

The valve holding member 16 is incorporated at the outer portion of the accumulator 2 thereof into the solenoid 15, and is provided there with a cap 17 so as to cover the solenoid 15. An armature chamber 22 is formed in a cylindrical member 18 disposed on the inside of the solenoid 15 and the cap 17. The armature 13 is movably provided with the armature chamber 22. A spring support member 19 is fixedly provided on the side of the cap 17 of the armature 13. The spring 14 is interposed between the armature 13 and the spring support member 19 so that the armature 13 is biased to the side of the accumulator 2 by a biasing force of the spring 14.

The control chamber 21 of the valve holding member 16 and the armature chamber 22 are provided therebetween with a through-hole communicating them, and the shaft 12 is movable inserted into the through-hole with no space. The shaft 12 is projected on each of both ends thereof into the control chamber 21 and the armature chamber 22, one end of which is connected to the armature 13 in the armature chamber 22, so as to be integrally movable with the armature 13 and so as to be biased to the side of the accumulator 2 by the biasing force of the spring 14. The shaft 12 is pressurized so as to contact on the other end thereof with the valving element 11 in the control chamber 21 and presses the valving element 11 to the side of the accumulator 2 with the armature 13 so as to be pressed and attached to the sheet surface 10*b* of the valve seat 10 and close the fuel passage 10*a* by the valving element 11.

The solenoid 15 disposed around the armature chamber 22 is connected to the controller 8 with the pressure sensor 7 detecting the fuel pressure in the accumulator 2. The controller 8 changes the supply voltage (or the supply current) to the solenoid 15 based on the detected value of the fuel pressure detected by the pressure sensor 7 and biases the armature 13 in the same direction as the biasing one of the spring 14 so as to control opening degree of the fuel passage 10*a* by the valving element 11 pressing via the shaft 12 and adjust the fuel volumes passing through the fuel passage 10*a*.

When the solenoid 15 is not energized, the armature 13 is biased to the side of the accumulator 2 by the biasing force of the spring 14, so that the fuel pressure in the accumulator 2 opening the fuel passage 10*a* is set up to be the predefined one. Meanwhile, when the solenoid 15 is energized, a force biasing in the same direction as the biasing one of the spring 14, i.e., the force increasing the predefined pressure of the spring 14 acts on the armature 13, depending on the largeness of exciting electrical power, and the armature 13 is also biased to the side of the accumulator 2, so that the fuel pressure in the accumulator 2 opening the fuel passage 10*a* is set up to be larger than the predefined one of the spring 14. Thus, the pressure control valve 6 is constituted so that the fuel pressure in the accumulator 2 can be kept to the given pressure, by controlling the largeness of exciting electrical power of the solenoid 15 using the controller 8. Incidentally, the given pressure of the spring 14 is set up in such a way that the fuel pressure in the accumulator 2 becomes a pressure that can inject the fuels, even if the solenoid 15 can not be energized due to the fault or the like.

As described above, the pressure control valve 6 is constructed so that it can adjust the fuel flowing volumes of the fuel passage 10*a*, i.e., the fuel escaping volumes from the fuel escaping passage 2*b* of the accumulator 2, so as to control the fuel pressure in the accumulator 2, by biasing the armature 13 to the side of the accumulator 2 in the armature chamber 22 due to the spring 14 and the solenoid 15, as well as by controlling the opening degree of the fuel passage 10*a* by the valving element 11 pressing via the shaft 12 by the armature 13 in the control chamber 21. The pressure control means 6 includes a means for attenuating the pressure transmitted from the accumulator 2 to the valve seat 10 in the valve seat 10, and a means for equalizing the pressures of the control chamber 21 and the armature chamber 22.

For example, as shown in FIG. 2, the pressure attenuating means includes an attenuating chamber 30 on the side of the accumulator 2 relative to the sheet surface 10*b*. The pressure attenuating means also includes a first aperture 31 between the attenuating chamber 30 and the accumulator 2, as well as a second aperture between the attenuating chamber 30 and the control chamber 21, those of which are constituted as the fuel passage 10*a* communicating the accumulator 2 with the control chamber 21. The attenuating chamber 30 is comprised of a large diameter portion of the fuel passage 10*a* in the valve seat 10 and an aperture forming member 35 inserted and fixed into the large diameter portion from the side of the accumulator 2, which is disposed on the approximately middle portion (in the axial direction) of the fuel passage 10*a*.

The first aperture 31 is made up of a small diameter bore formed in the aperture forming member 35, at one end of which is connected to the fuel inflowing side of the attenuating chamber 30, and at the other end of which is connected to the accumulator 2. The second aperture 32 is made up of a small diameter portion of the fuel passage 10*a* in the valve seat 10, at one end of which is connected to the fuel discharging side of the attenuating chamber 30, and at the other end of which is connected to the control chamber 21. When the fuels pass through the fuel passage 10*a*, they are set up to be introduced from the accumulator 2, via the first aperture 31, the attenuating chamber 30 and the second aperture 32 in this order, to the control chamber 21.

Thus, while the pressure is transmitted from the accumulator 2 to the valve seat 10 of the pressure control valve 6, it is attenuated through the attenuating chamber 30 and the apertures 31, 32, so that the pressure fluctuation in the accumulator 2 is not directly transmitted to the valve seat 10. In this regard, the pressure attenuating means is not limited to the above-mentioned construction, it may be provided with the attenuating chamber or the aperture in the valve seat 10 without the aperture forming member 35 or alternatively may be provided with an orifice instead.

As seen from the above, in the accumulator fuel injection device equipped with the pressure control valve 6 controlling the fuel pressure in the accumulator 2 by moving the armature 13 in the armature chamber 22 and by adjusting the escaped volumes of the fuels from the accumulator 2 due to the valving element 11 comprised integral with the armature 13 in the control chamber 21 introducing the fuels in the accumulator 2, because the valve seat 10, which is disposed between the control chamber 21 of the pressure control valve 6 and the accumulator 2, is provided with the means for attenuating the pressure transmitted from the accumulator 2 to the valve seat 10, the pressure fluctuation in the accumulator 2 can not be directly transmitted to the valve seat 10 of the pressure control valve 6 due to the pressure attenuating means, thereby minimizing the pressure fluctuation of the valve seat 10 so as to stabilize the operation of the pressure control valve 6.

In the accumulator fuel injection device, the pressure attenuating means is constructed so that it includes the attenuating chamber 30 in the valve seat 10 and the respective apertures 31, 32 on each of the side of the accumulator 2 and the side of the control chamber 21 of the attenuating chamber 30, respectively, whereby the pressure attenuating means can be constituted with a simple structure so as to restrain the production cost.

Also, for example, as shown in FIG. 2, the pressure equalizing means, is constructed in such a way that the shaft 12 extended from the armature chamber 22 to the control chamber 21 is provided with the first continuous hole 12*a*, and the armature 13 connected to the shaft 12 in the armature chamber 22 is provided with the second continuous hole 13*a*, as well as the first continuous hole 12*a* and the second continuous hole 13*a* are communicated with each other. The first continuous hole 12*a* includes a longitudinal continuous hole 41 extended in the direction perpendicular to the axial direction of the shaft 12 and a horizontal continuous hole 42 extended in the axial direction of the shaft 12. The longitudinal continuous hole 41 is extended to the outer peripheral surface of the shaft 12 so as to reach the control chamber 21, and the horizontal continuous hole 42 communicating with the longitudinal continuous hole 41 is extended to the inside of the armature 13 so as to communicate with the second continuous hole 13*a*.

Figure 3:
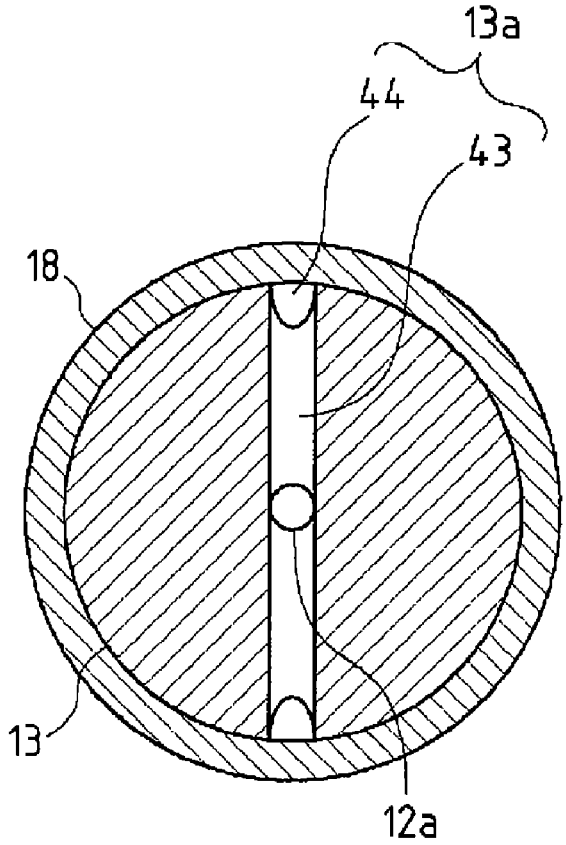
FIG. 3 is a cross-sectional view of an armature portion along the line X-X in FIG. 2.

The second continuous hole 13*a* is comprised of a longitudinal continuous hole 43 extending in a direction perpendicular to the axial direction of the armature 13 and a horizontal continuous hole 44 extending in the axial direction of the armature 13. The longitudinal continuous hole 43 communicating with the first continuous hole 12*a* is extended to the outer peripheral surface of the armature 13 so as to communicating with the horizontal continuous hole 44, and the horizontal continuous hole 44 is extended to the respective ends of the accumulator 2 side and the cap 17 side of the armature 13 so as to reach the armature chamber 22. In this regard, as shown in FIG. 3, the horizontal continuous hole 44 includes a chase extended in the axial direction on the outer peripheral portion of the armature 13 and the cylindrical member 18 that incorporates the armature 13 with no space.

In this way, the control chamber 21 is communicated with the armature chamber 22 via the first continuous hole 12*a* of the shaft 12 and the second continuous hole 13*a* of the armature 13, so as to be equalize the pressures of the control chamber 21 and the armature chamber 22, so that the pressures, which are acting on each of the end portion of the control chamber 21 side of the shaft 12 and the end portion of to the armature chamber 22 side of the armature 13, are balanced out. Incidentally, the second continuous hole 13*a* provided with the armature 13 is not limited to the above-described construction, and it may be formed so as to penetrate the armature 13, and especially when the horizontal continuous hole 42 of the first continuous hole 12*a* is provided so as to be extended, it may be comprised only of the horizontal continuous hole 44 without the longitudinal continuous hole 43.

As seen from the above, in the accumulator fuel injection device equipped with the pressure control valve 6 controlling the fuel pressure in the accumulator 2 by moving the armature 13 in the armature chamber 22 and by adjusting the escaped volumes of the fuels from the accumulator 2 due to the valving element 11 comprised integral with the armature 13 in the control chamber 21 communicating with the accumulator 2, because the pressure control valve 6 is provided with the means for equalizing the pressures of the control chamber 21 and the armature chamber 22, the pressures acting on each of the end portions of the control chamber 21 side acting on the valving element 11 and the armature chamber 22 side in the armature 13, i.e., the pressures, which are acting on each of the end portion of the control chamber 21 side of the armature 13 and the end portion of the control chamber 21 side of the shaft 12 comprised integral with the armature 13, can be balanced out, thereby accurately controlling the valving element 11 by the armature 13 so as to stabilize the operation of the pressure control valve 6.

In the accumulator fuel injection device, the pressure equalizing means includes the respective continuous holes 13*a*, 12*a* communicating the control chamber 21 with the armature chamber 22 in each of the armature 13 and the shaft 12 comprised integral with the armature 13 so as to act on the valving element 11, so that the pressure equalizing means can be constituted using a simple structure so as to restrain the production cost.

The accumulator fuel injection device of the present invention is applicable in that it can stabilize the operation of the pressure control valve controlling the fuel pressure in the accumulator.

The invention claimed is:

1. A pressure regulation valve for controlling a fuel pressure of an accumulator in an accumulator fuel injection device comprising integrally of:

an armature chamber, an armature moving in the armature chamber, a control chamber introducing the fuels in the accumulator, a valving element and a valve seat having a passage formed between the accumulator and the control chamber, the pressure regulation valve wherein escaped volumes of the fuels from the accumulator to the control chamber are adjusted by moving the valving element with the movement of the armature so as to open and close the passage in the valve seat, wherein the passage in the valve seat is provided with an attenuating chamber and the attenuating chamber is provided on each of the side of the accumulator and the side of the control chamber with apertures, so that a pressure attenuating means for attenuating the pressures transmitted from the accumulator via the passage to the valve seat is comprised of the attenuating chamber and both apertures.

2. A pressure regulation valve for controlling a fuel pressure of an accumulator in an accumulator fuel injection device comprising integrally of:

an armature chamber, an armature moving in the armature chamber, a control chamber introducing the fuels in the accumulator, a valving element and a shaft moving integral with the armature so as to move the valving element, the pressure regulation valve wherein escaped volumes of the fuels from the accumulator to the control chamber are adjusted by moving the valving element with the movement of the armature and the shaft so as to open and close the passage between the accumulator and the control chamber, wherein the shaft is provided with a first continuous hole communicating with the control chamber, and the armature is provided with a second continuous hole communicating with the first continuous hole and the armature chamber, so that the pressure equalizing means for equalizing the pressures of the control chamber and the armature chamber is comprised of the first continuous hole and the second continuous hole and the second continuous hole has a continuous hole consisting of a chase on the outer peripheral portion of the armature and a cylindrical member that incorporates the armature with no space.

* * * * *